US008301069B2

(12) United States Patent
Matsui et al.

(10) Patent No.: US 8,301,069 B2
(45) Date of Patent: Oct. 30, 2012

(54) COOLING A RECORDING MEDIUM USING AN EDDY AIR FLOW

(75) Inventors: Michinori Matsui, Kanagawa (JP); Naoki Yoneyama, Kanagawa (JP); Masaru Tanaka, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 981 days.

(21) Appl. No.: 12/341,418

(22) Filed: Dec. 22, 2008

(65) Prior Publication Data

US 2009/0244581 A1 Oct. 1, 2009

(30) Foreign Application Priority Data

Apr. 1, 2008 (JP) ..... P2008-095463

(51) Int. Cl.
*G03G 15/20* (2006.01)

(52) U.S. Cl. ..... 399/341

(58) Field of Classification Search ..... 399/341
See application file for complete search history.

(56) References Cited

U.S. PATENT DOCUMENTS

2008/0181688 A1* 7/2008 Kurita ..... 399/341

FOREIGN PATENT DOCUMENTS

| | | |
|---|---|---|
| JP | 2005-257893 | 9/2005 |
| JP | 2005-266233 A | 9/2005 |
| JP | 2006-184549 A | 7/2006 |
| JP | 2007-219399 | 8/2007 |
| JP | 2007-264417 A | 10/2007 |

* cited by examiner

*Primary Examiner* — Benny Q Tieu
*Assistant Examiner* — Eric A Rust
(74) *Attorney, Agent, or Firm* — Sughrue Mion, PLLC

(57) ABSTRACT

A cooling apparatus includes: a stacker vessel in which a medium having a fixed visible image is ejected and stacked; and an eddy flow generating device that is arranged in an upper portion of the stacker vessel, and generates an eddy flow which flows along a surface of the medium transported into the stacker vessel to make an eddy and cools the medium.

3 Claims, 5 Drawing Sheets

COOLING A RECORDING MEDIUM USING AN EDDY AIR FLOW

CROSS-REFERENCE TO RELATED APPLICATIONS

This application is based on and claims priority under 35 U.S.C. 119 from Japanese Patent Application No. 2008-095463 filed Apr. 1, 2008.

BACKGROUND

1. Technical Field

This invention relates to a cooling apparatus and an image forming apparatus.

SUMMARY

According to an aspect of the present invention, a cooling apparatus includes: a stacker vessel in which a medium having a fixed visible image is ejected and stacked; and an eddy flow generating device that is arranged in an upper portion of the stacker vessel, and generates an eddy flow which flows along a surface of the medium transported into the stacker vessel to make an eddy and cools the medium.

BRIEF DESCRIPTION OF THE DRAWINGS

Exemplary embodiment of the present invention will be described in detail based on the following figures, wherein:

FIG. 3 is a view for explaining a gas moving device according to an exemplary embodiment of this invention.

DETAILED DESCRIPTION

Figure 1:
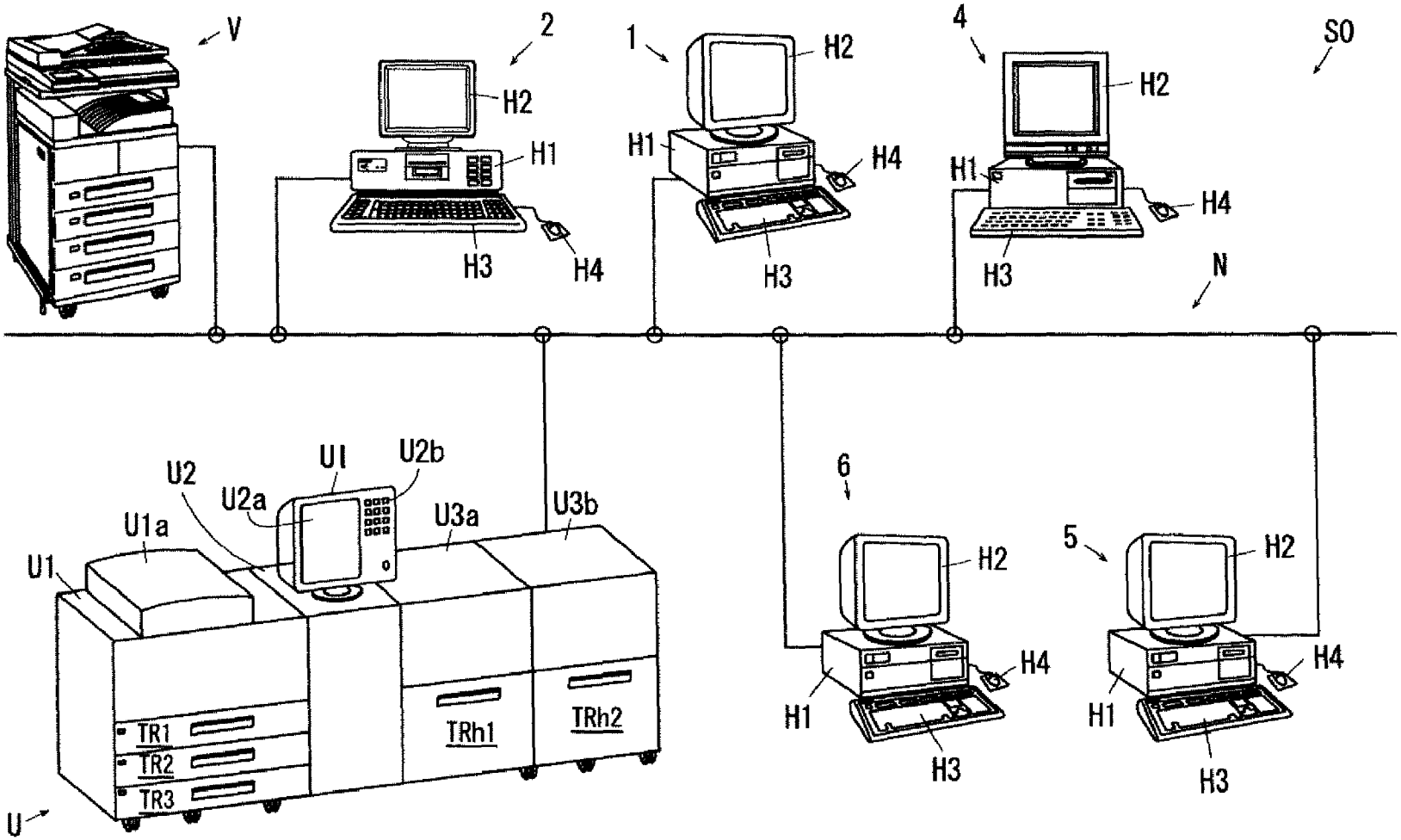
FIG. 1 is a view for explaining the entire arrangement of an image forming system according to the first exemplary embodiment of this invention.

Now referring to the drawings, an explanation will be given of various embodiments in the mode of carrying out this invention, but this invention should not be limited to the following embodiments.

For facilitating the understanding of the following explanation, it is assumed in the drawings that the fore-aft direction is an X-axis direction, the left-right direction is a Y-axis direction and the up-down direction is a Z-axis direction, and also assumed that the directions or sides denoted by arrows X, −X, Y, −Y, Z and −Z are forward, rearward, rightward, leftward, upward and downward, or front side, rear side, right side, left side, upper side and lower side, respectively.

Further, in the drawings, the symbol containing "." in "O" means the arrow going from rear to front of the paper face, and the symbol containing "x" in "O" means the arrow going from front to rear of the paper face.

In the explanation referring to the drawings, for easiness of the understanding, those other than constitution and members necessary for the explanation are not appropriately illustrated.

(Embodiment 1)

FIG. 1 is a view for explaining the entire arrangement of an image forming system according to the first embodiment of this invention.

In FIG. 1, an image forming system SO according to the first exemplary embodiment of this invention has an information communication line network N. The information line network N is connected with an image information transmitting end terminal 1 for transmitting image information for printing by users, a management device 2 for managing the information transmitted/received through the information communication line network N, other end terminals 4, 5, 6 and an image forming apparatus U according to the first embodiment of this invention for doing the printing on the basis of the image information transported from the respective end terminals 1, 4, 5, 6, and another image forming apparatus V so that transmission/reception of information can be done among them.

The respective end terminals 1, 4 to 6 and the management device 2 are construed of a computer device which is an example of an information processing device. The computer device includes a device body H1, a display H2, a keyboard H3 and a mouse H4 which are an example of an input device, and a hard disk drive which is an example of an information storage device not shown. In the end terminals 1, 4 to 6, a program for controlling the basic operation of the computer device or "software" is built. The software is for example, a basic software program or "an operating system", a word-processor software program for creating a document, a drawing creating software program, an application program such as a software program for transmission/reception of electronic mails, and a printer driver which is an example of the software program for controlling the respective image forming apparatuses U, V.

(Explanation of the Image Forming Apparatus According to the First Embodiment of this Invention)

Figure 2:
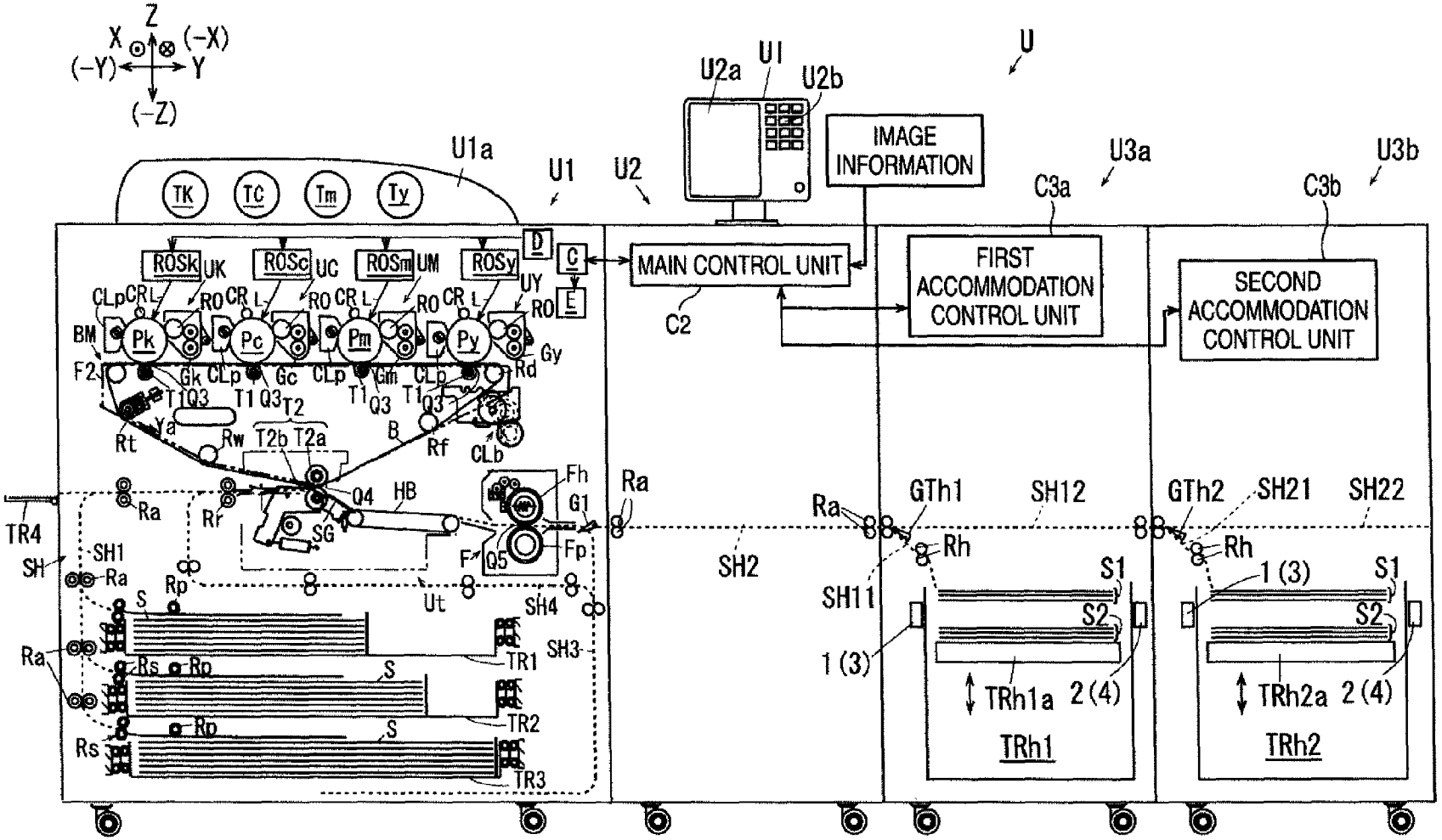
FIG. 2 is a view for explaining the entire arrangement according to the first exemplary embodiment of this invention.

FIG. 2 is a view for explaining the entire arrangement according to the first exemplary embodiment of this invention.

In FIG. 2, the image forming apparatus U is constructed of a large-scale printer U which includes an image forming apparatus body U1, an interface module U2 which is an example of an operating unit having an operating unit U1 for operating the printer U, and a first stacker device U3*a* and a second stacker device U3*b* which are an example of a medium ejecting device.

(Explanation of the Image Forming Apparatus Body)

In FIG. 2, the image forming apparatus body U1 includes a body side control unit C for controlling the image forming apparatus body U1, an information transmission/reception device (not shown) for receiving the image information transmitted from the respective end terminals 1, 4 to 6 connected by the information communication line network N, a latent image forming device driving circuit D controlled by the body side control unit C and a power source circuit E. The latent image forming device driving circuit D whose operation is controlled by the body side control unit C creates the image information of the respective colors of yellow, magenta, cyan and black based on the image information transmitted from the respective end terminals 1, 4 to 6 and sends the corresponding driving signals, at predetermined timings, to latent image forming devices ROSy, ROSm, ROSc, ROSk of visible image forming devices of visible image forming devices DY, UM, UC, UK of the respective colors. The visible image forming devices UY, UM, UC, UK of the respective colors are movably supported between a drawing position where they are drawn forward from the image forming apparatus body U1 and mounting position where they are mounted within the image forming apparatus body U1.

In each visible image forming device UY, UM, UC, UK, around an image carrier Py, Pm, Pc, Pk, a charger CR, developing device Gy, Gm, Gc, Gk, and an image carrier cleaner CLp are arranged.

In FIG. 2, after the image carrier Py, Pm, Pc, Pk is uniformly charged by the charger CR, by the latent image writing light L produced from the latent image forming device ROSy, ROSm, ROSc, ROSk, the latent image is formed on the surface of the image carrier. The latent image on the surface of the image carrier Py, Pm, Pc, 2k is developed into a visible image, or "toner image" of yellow, magenta, cyan, black by the developing device Gy, Gm, Gc, Gk. When the developer in the developing device Gy, Gm, Gc, Gk is consumed due to the development, the developer is supplied from a developer supplying device U1*a* arranged on the image forming apparatus body U1. In the developer supplying device U1*a*, a developer supplying vessel or "toner cartridge" Ty, Tm, Tc, Tk is detachably and exchangeably supported.

The visible images on the image carriers Py, Pm, Pc, Pk surface are sequentially superposedly transferred onto an intermediate transfer belt B which is an example of an intermediate transfer body by a primary transfer roll T1 which is an example of a primary transfer device. Thus, a multiple-color image is formed on the intermediate transfer belt B. The multiple color image formed on the intermediate transfer belt B is transported to a secondary transfer region Q4.

In the case of a monochromatic image, only the image carrier Pk of black K and the developing device Gk are employed to form the visible image of black K.

After the primary transfer, the residue on the image carrier Py, Pm, Pc, Pk surface is removed and cleaned by an image carrier cleaner CLp.

Below the visible image forming device UY, UM, UC, UK, a belt module BM which is an example of an intermediate transfer device is arranged. The belt module BM has the intermediate transfer belt B. The intermediate transfer belt B is rotatably supported in a direction of arrow Ya by a driving roll Rd which is an example of an intermediate transfer body driving member, a tension roll Rt which is an example of a tension generating member, a walking roll Rw which is an example of an meandering preventing member, a plurality of idler rolls Rf which are an example of a driven member, a backup roll T2*a* which is an example of a secondary transfer opposite member and the primary transfer roll T1. In the first embodiment, these members Rd, Rt, Rw, Rf, T2*a* and T1 are constructed of "roll-like members".

Below the backup roll T2*a*, a secondary transfer unit Ut is arranged. The secondary transfer unit Ut is provided with a secondary transfer roll T2*b* which is an example of a secondary transfer member. The secondary transfer roll T2*b* is arranged to be contactable with or separatable from the backup roll T2*a* across the intermediate transfer belt B. The region where the secondary transfer roll T2*b* is in pressure-contact with the intermediate transfer belt B constitutes a secondary transfer region Q4. Further, in the first embodiment, a contact power-supplying member T2*c* is kept in contact with the backup roll T2*a*. To the contact power-supplying member T2*c*, a secondary transfer voltage with the same polarity as the charging polarity of the developer is applied at predetermined timings from the power source circuit E controlled by the body side control unit C.

The secondary transfer opposite member T2*a*, secondary transfer member T2*b* and contact power-supplying member T2*c* constitute a secondary transferring device T2 in the first embodiment. The primary transfer roll T1, intermediate transfer belt B and secondary transferring device T2 constitute a transferring device according to the first embodiment.

Below the intermediate transfer belt B, sheet feeding trays TR1 to TR3 are provided which are an example of a medium accommodating vessel in which recording sheets S which are an example of a recording medium are accommodated. The recording sheets S accommodated in the sheet feeding trays TR1 to TR3 are taken out by a pickup roll Rp which is an example of a medium take-out member and separated one by one by a loosening roll Rs which is an example of a loosening member. Thereafter, the sheet is transported to the sheet feeding path SH1. The recording sheet S transported to the sheet feeding path SH1 is transported to a register roll Rr which is an example of a sheet feeding timing adjusting member by a transporting roller Ra which is an example of a transporting member.

The recording sheet S transported to the register roll Rr is transported to the secondary transfer region Q4 at the timing when the multiple-color or monochromatic image is transported to the secondary transfer region Q4.

The multiple-color image on the intermediate transfer belt B, when it passes the secondary transfer region Q4, is transferred to the recording sheet S by the secondary transferring device T2. In the case of the multiple-color image, the toner images primary-transferred superposedly on the intermediate transfer belt B are collectively secondary-transferred to the recording sheet S.

The intermediate transfer belt B after the second transfer is cleaned by a belt cleaner CLb which is an example of an intermediate transfer body cleaner.

The recording sheet S with a non-fixed visible image secondary-transferred is transported to a fixing device F through an after-transfer guiding member SG and a medium transporting member HB. The fixing device F includes an heating roll Ph which is an example of a heating/fixing member and a pressurizing roll Fp which is an example of a pressurizing/fixing member. The recording sheet S is transported to a fixing region Q5 with which a pair of fixing members Fh, Pp are in contact in a pressurized state. The non-fixed visible image on the recording sheet S is heated/fixed by the fixing device F when it passes the fixing region Q5.

Downstream of the fixing device F, a switching member G1 is provided. The switching member G1 selectively changes the recording sheet S transported along the transporting path SH1 and subjected to the heating/fixing at the fixing region Q5 into a relay path SH2 of the interface module U2 or an inverting path SH3. The recording sheet S transported to the inverting path SH3 is transported in a reverse direction, or switched back. Thus, the recording sheet is transported to a circulating path SH4 so that it is transported the transfer region Q4 again through the register roll Rr.

The components denoted by the symbols SH1, SH3 and SH4 constitute the body side medium transporting path SH.

(Explanation of the Interface Module U2)

Referring to FIG. 2, the interface module U2 according to the first embodiment is provided, at its upper end, with an operating unit U1 including a display unit U2*a* for displaying information and an input button U2*b* for making various settings for the image forming apparatus U. The interface module US is further provided with a main control unit C2 for receiving the image information transmitted from the respective end terminals 1, 4 to 6 and management device 2 to do various items of processing and control for the image forming apparatus U.

Inside the interface module U2, formed is the relay path SH2 which is an example of a transporting path along which the recording sheet S subjected to the fixing in the image forming apparatus body U1 is transported. On the relay path SH2, a transporting roll Ra which is an example of a transporting member for transporting the recording sheet S downstream.

In the interface module U2 according to the first embodiment, arranged is a thermometer and a hygrometer not shown which are an example of an environment measuring device for detecting the temperature and humidity of the environment where the printer U is established.

(Explanation of a First Stacker Device U3*a* and a Second Stacker Device U3*b*)

Next, an explanation will be given of the first stacker device U3*a* and second stacker device U3*b*. Since these two stacker devices U3*a*, U3*b*are constructed in the same manner, for simplicity of explanation, the first stacker device U3*a* will be explained with the denotation of the "first", and a detailed explanation will not be given of the second stacker device U3*b*.

Referring to FIG. 2, the first stacker device U3*a* according to the first embodiment has a first ejecting path SH11 connected to the relay path SH2. Downstream of the first ejecting path SH11, arranged is a first ejecting roller Rh which is an example of a medium ejecting member. The recording sheet S is ejected/stacked into a first stacker vessel TRh1, which is an example of a stacking vessel, arranged below the first ejecting roller Rh. Inside the first stacker vessel TRh1 arranged is a first bottom plate TRh1*a* which is an example of a stacking member on which the recording sheets S are stacked. The first bottom plate TRh1*a* automatically ascends or descends according to the stacking volume of the recording sheets S.

From the upstream end to the second stacker device U3*b* side of the first ejecting path SH11, extended is a first re-relay path SH12 for transporting the recording sheet S to the second stacker device U3*b* additively connected to the first stacker device U3*a*. On the first re-relay path SH12, arranged are a plurality of transporting rollers Ra. At the branching point of the first ejecting path SH11 and the first re-relay path SH12, arranged is a first ejecting gate GTh1 which is an example of a first ejection switching member for switching between the transporting paths SH11 and SH12.

(Explanation of an Eddy Current Generating Device)

Figure 3A:
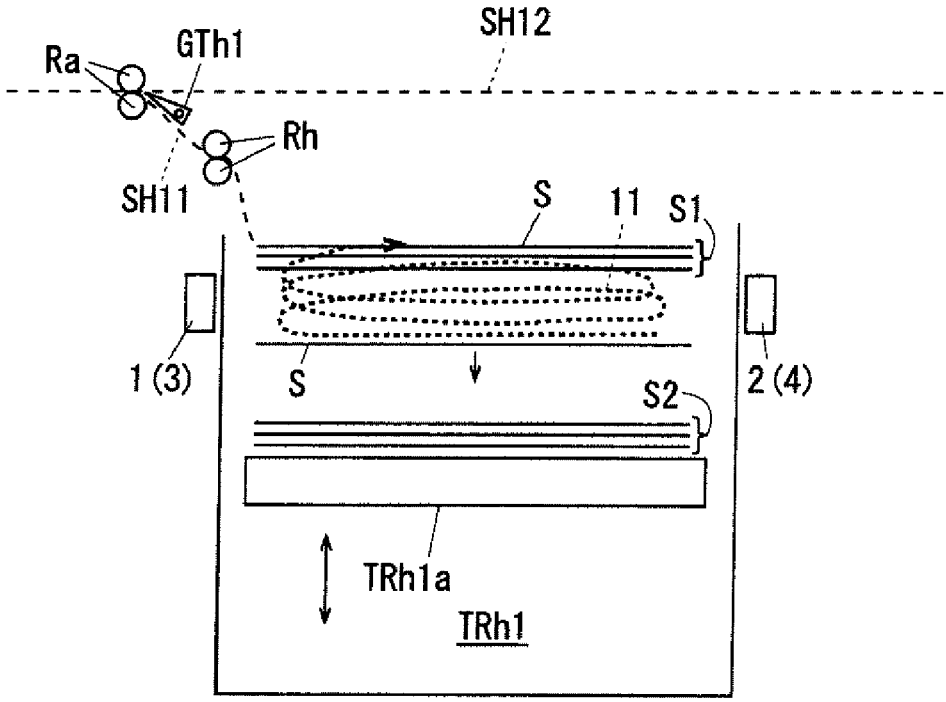
FIG. 3A is a front view and FIG. 3B is a plan view.
Figure 3B:
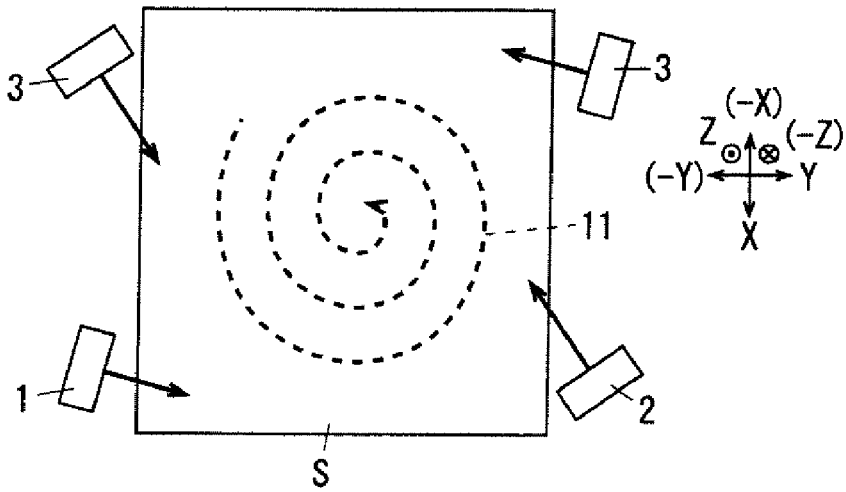

FIG. 3 is a view for explaining an air sending device according to an embodiment of this invention. FIG. 3A is a front view and FIG. 3B is a plan view.

Referring to FIG. 3, in the first stacker device U3*a* according to the first embodiment, at the upper part of the first stacker vessel TRh1 and below the first ejecting roller Rh, arranged are two pairs of first draft fans 1, 2, 3, 4, which are an example of an eddy current generating device, on both right and left sides. The first blower fans 1 to 4 are arranged so that the axial lines of the blown winds are displaced from one another and so the winds blown from the four first blower fans 1 to 4 are merged to create an eddy current 11 which is an eddy air current along the surface of the medium S. The first blower fans 1 to 4 according to the first embodiment are so adapted that the volume of air is adjustable.

(Explanation of the Control Unit According to the First Embodiment)

Next, an explanation will be given of the respective functional parts in the image forming system SO according to the first embodiment. Tn the first embodiment, from the respective end terminals 1, 4 to 6, the image information is only transmitted through the corresponding drivers according to an input of doing printing. This is well known and so not explained in detail.

(Explanation of the Printer U)

Figure 4:
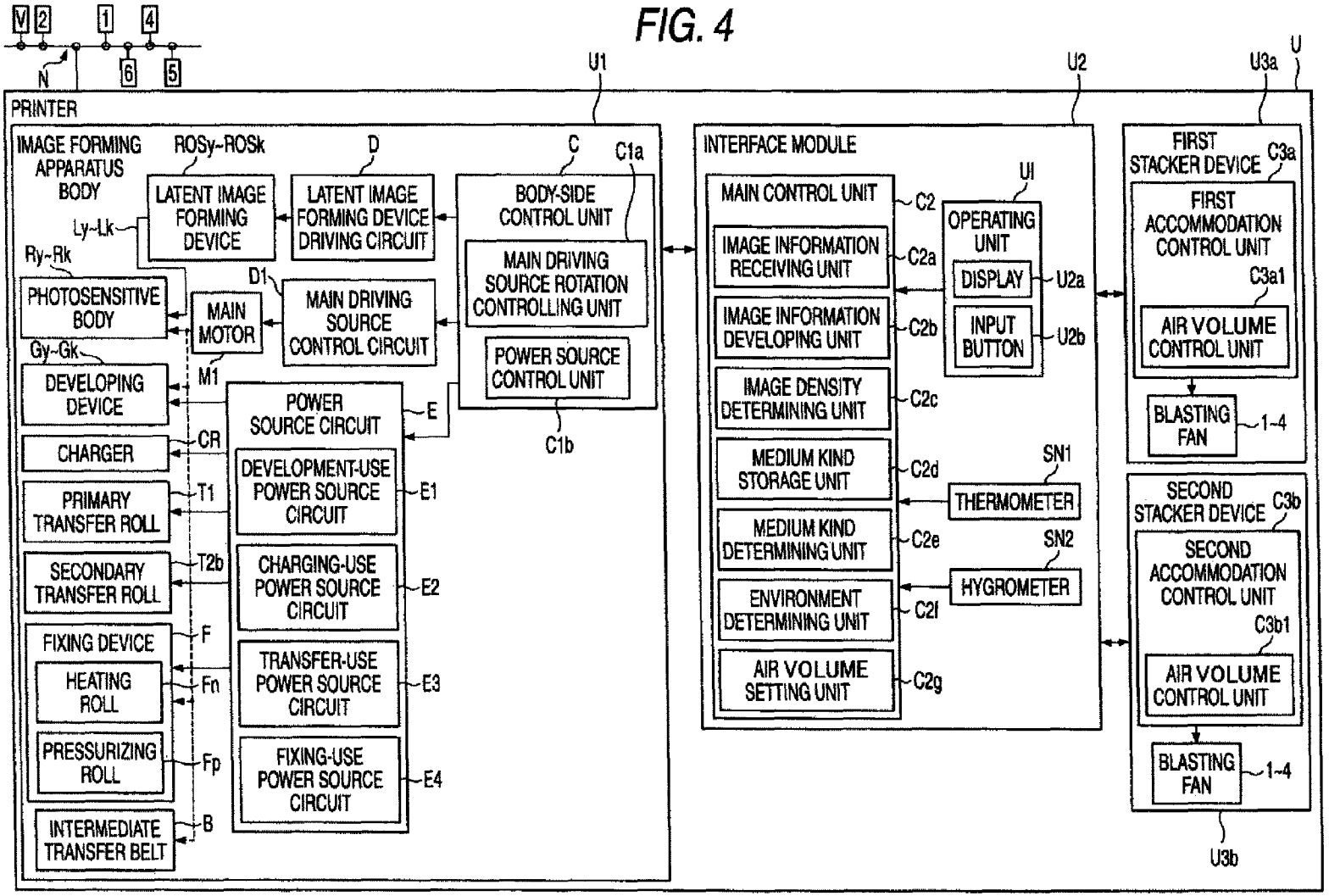
FIG. 4 is a view for explaining the main part in the control unit of an image forming apparatus in the image forming system according to the first exemplary embodiment of this invention.

FIG. 4 is a view for explaining the main part in the control unit of an image forming apparatus in the image forming system according to the first embodiment of this invention.

Referring to FIG. 4, the body-side control unit C in the printer U according to the first embodiment is constructed of a "microcomputer" which includes an input/output device which is an I/O for doing the input/output of signals for the outside and adjustment of the input/output signal level, storage devices ROM, HDD in which programs and information for doing necessary processing are stored, a temporary storage device RAM for temporarily storing necessary data, a central processing unit CPU for doing the processing corresponding to the programs stored in the ROM, HDD and RAM, and an oscillator not shown generating synchronizing signals for taking synchronization of circuits, i.e. clocks.

In FIG. 4, the printer U having the above configuration can realize various functions by executing the image forming programs stored in the read-only memory ROM or hard disk drive HOD which is an example of the storage device and random-access memory RAM which is an example of the temporary storage device.

(Signal Input Components Connected to the Body-Side Control Unit C)

Output signals from the main control unit C2 are inputted to the body-side control unit C.

(Controlled Component Connected to the Body-Side Control Unit C)

The body-side control unit C produces control signals for the following controlled components.

D1: Main Driving Source Control Circuit

The main driving source control circuit D1 rotationally drives the image carrier Py, Pm, Pc, Pk, secondary transfer member T2*b*, fixing device F and intermediate transfer belt B by driving a main motor M1 which is an example of a main driving source.

E: Power Source Circuit

The power source circuit E includes a development-use power source circuit E1 for applying a developing voltage to the developing device Gy, Gm, Gc, Gk, a charging-use power source circuit E2 for applying a charging voltage to the charger CR, a transfer-use power source circuit E3 for applying a transfer voltage to the primary transfer member T1 and secondary transfer member T2*b* and a fixing-use power source circuit E4 for supplying a heating power source to the fixing device F.

D: Latent Image Forming Device Driving Circuit

The latent image forming device driving circuit D controls the latent image forming device ROSy, ROSm, ROSc, ROSk to form the latent image.

(Function of the Body-Side Control Unit C)

The body-side control unit C has a function realizing parts for realizing the function of supplying the control signal to each controlled component by executing the processing corresponding to the output signal produced from each signal outputting component, i.e. "program module constituting an image forming program". Next, an explanation will be given of the function realizing parts for realizing various functions of the body-side control unit C.

C1*a*: Main Driving Source Rotation Controlling Parts

The main driving source rotation controlling parts C1*a* controls the image carrier Py, Pm, Pc, Pk by controlling the operation of the main motor M1 through the main driving source control circuit D1.

C1*b*: Power Source Circuit Controlling Parts

The power source circuit controlling parts C1*b* controls the development voltage, charging voltage, transfer voltage and fixing temperature by controlling the power source circuit E.

(Signal Input Components Connected to the Main Control Unit C2)

The main control unit C2 is supplied with the output signals from the operating unit U1, thermometer SN1 and hygrometer SN2.

The operating unit U1 includes the display unit U2*a* on which the image is displayed and an input button U2*b* for executing various inputs. The display unit U2*a* may be e.g. a liquid crystal display and the input butting U2*b* may include a "ten key", copy-start key, etc.

The thermometer SN1 serves to measure the environmental temperature of the printer U.

The hygrometer SN2 serves to measure the environmental humidity of the printer U.

(Controlled Components Connected to the Main Control Unit C2)

The main control unit C2 produces a control signal for driving the transporting roller Ra of the relay path SH2, and control signals for the body-side control unit C and respective accommodation control unit C3*a*, C3*b* of each stacker device U3*a*, U3*b*.

(Function of the Main Control Unit C2)

The main control unit C2 has a function realizing parts for realizing the function of supplying the control signal to each controlled component by executing the processing corresponding to the output signal produced from each signal outputting component, i.e. "program module". Next, an explanation will be given of the function realizing unit for realizing various functions of the main control unit C2.

C2*a*: Image Information Receiving Unit

The image information receiving unit C2*a* receives and stores the image information of a printing object transmitted from the respective end terminals 1, 4 to 6.

C2*b*: Image Information Developing Unit

The image information developing unit C2*b* converts and develops the image information received into printing image information which is the information for printing.

C2*c*: Image Density Determining Unit

The image density determining unit C2*c* determines whether or not the image density of the image fixed on the recording sheet S surface is higher than a prescribed image density. The image density determining unit C2*c* according to the first embodiment determines the image density on the basis of the printing image information developed by the image information developing unit C2*b*. Further, in the first embodiment, as an example of the prescribed image density, the image density of 10% is stored. However, without limited to 10%, the prescribed image density may be changed according to the design and specification. In the first embodiment, where the image information covers plural pages, if the image density of any one page exceeds 10%, it is determined that the pertinent image is a high density image. Further, an average image density is form 4% to 6%, the image density determining unit C2*c* may determine whether or not the image density of the image fixed on the recording sheet S surface is higher than the average image density.

However, without being limited to such a manner, for example, if the average image density of all the pages exceeds the prescribed value, it may be determined that the pertinent image is the high density image or otherwise if the image density of all the pages exceeds the prescribed value, it may be determined that the pertinent image is the high density image.

C2*d*: Medium Kind Storage Unit

The medium kind storage unit C2*d* stores the kind of the recording sheets S accommodated in the respective sheet feeding trays TR1 to TR3. The medium kind storage unit C2*d* according to the first embodiment stores a normal sheet, a thick sheet, thin sheet, a coated sheet, etc. as the medium kind.

C2*e*: Medium Kind Determining Unit

The medium kind determining unit C2*e* determines the kind of the sheets S to be employed. The medium kind determining unit C2*e* according to the first embodiment determines whether or not the medium kind of the recording sheets S is the coated sheet which is an example of an affixing-prone medium prone to generate affixing between the recording sheets S.

C2*f*: Environment Determining Unit

The environment determining unit C2*f* determines, on the basis of the environmental temperature and environmental humidity, whether the pertinent environment is an environment where the affixing between the recording sheets S is prone to occur. The environment determining unit C2*f* according to the first embodiment determines whether or not the pertinent temperature is 30° C. or higher which is an example of the environmental temperature where the medium is resistant to be cooled and affixing is prone to occur, and also determines whether or not the pertinent environmental humidity is 30% RH or lower which is an example of the environmental humidity where affixing is prone to occur owing to static electricity. The concrete numerical values for determining whether the pertinent environment is at a high temperature and a low humidity should not limited to the above exemplary values, but can be optionally changed according the design and specification.

C2*g*: Air Volume Setting Unit

The air volume setting unit C2*g* sets the volume of air sent from the blasting fans 1 to 4 of the stacker devices U3*a*, U3*b* for ejection. The air volume setting unit C2*g* according to the first embodiment sets the volume of air sent from the blasting fans 1 to 4 controlled by the air volume controlling unit of the stacker device U3*a*, U3*b*. Further, the air volume setting unit C2*g*, where the image density on the recording sheet S surface is high, sets a large volume of air to be sent from the blasting fans 1 to 4 and also where the medium kind is the coated sheet, sets a large volume of air sent from the blasting fans 1 to 4.

(Signal Input Components Connected to the Accommodation Control Unit C3*a*, C3*b*)

Output signals from the main control unit C2 and others are supplied to the first accommodation control unit C3*a* and second accommodation control unit C3*b* of the first stacker device U3*a* and second stacker device U3*b*.

(Controlled Components Connected to the Accommodation Control Unit C3*a*, C3*b*)

The accommodation control unit C3*a*, C3*b* produces a control signal for driving the ejecting roller Rh and transporting roller Ra.

(Function of the Accommodation Control Unit C3*a*, C3*b*)

The accommodation control unit C3*a*, C3*b* has a function realizing unit for realizing the function of supplying the control signal to each controlled component by executing the processing corresponding to the output signal produced from each signal outputting component, i.e. "program module". Next, an explanation will be given of the function realizing unit for realizing various functions of the accommodation control unit C3*a*, C3*b*. The air volume controlling unit C3*b*l of the second stacker device U3*b*, which is the same as the air volume control unit C3*a*l of the first stacker device U3*a*, will not be explained here.

C3*a*l: Air Volume Controlling Unit

The air volume controlling unit C3*a*1, C3*b*1, which is an example of an eddy current controlling unit, controls the blasting fans 1 to 4 on the basis of the air volume set by the air volume setting unit C2*g*, i.e. air volume, thereby controlling the volume of air sent from the blasting fans X to 4 so that the eddy current to be generated is controlled.

(Explanation of the Flowchart of the Printer U)

(Explanation of the Flowchart of Cooling Control Processing)

Figure 5:
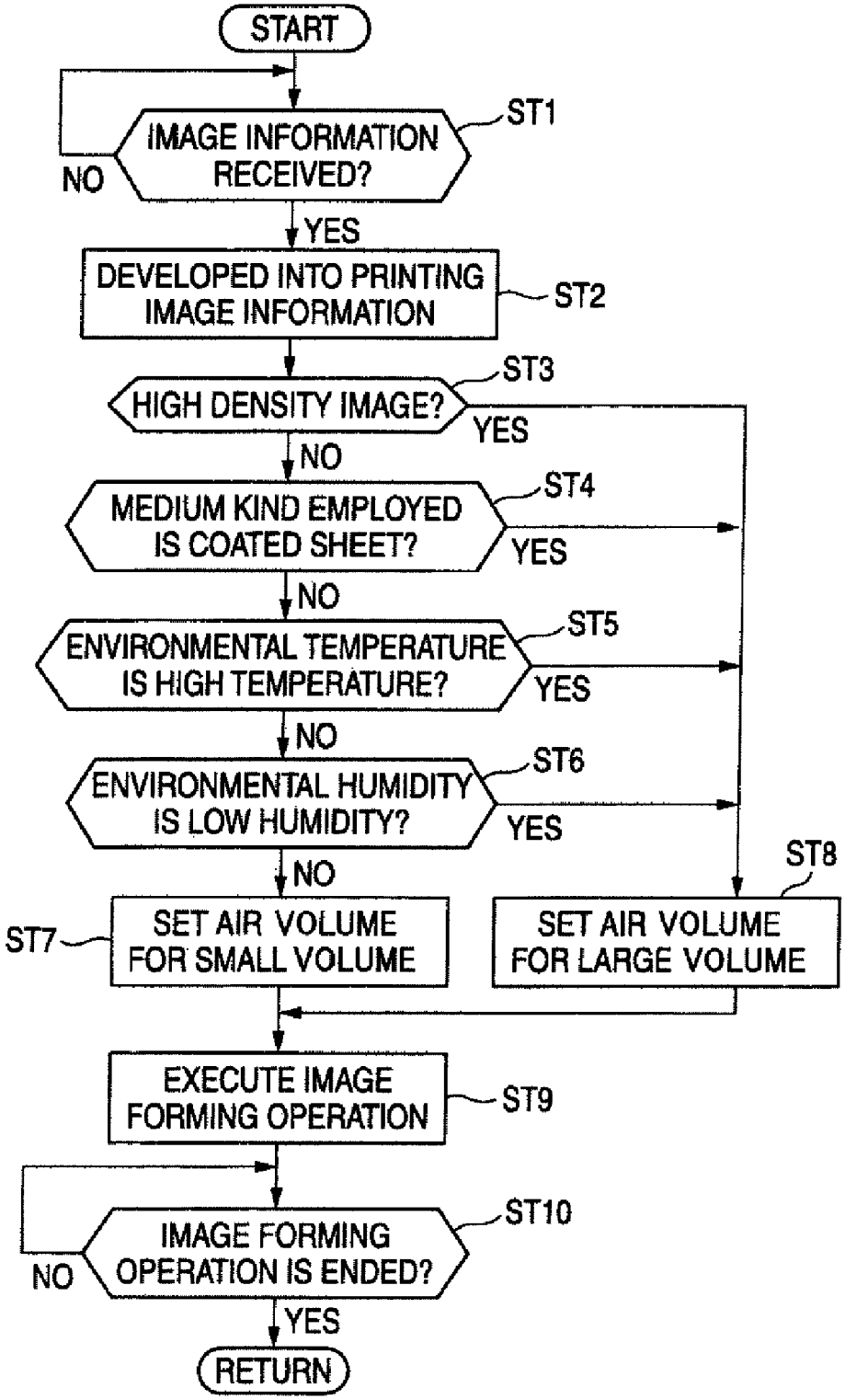
FIG. 5 is a flowchart of cooling control processing in the image forming apparatus according to the first exemplary embodiment.

FIG. 5 is a flowchart of cooling control processing in the image forming apparatus according to the first embodiment.

The processing in each ST (step) in the flowchart shown in FIG. 5 will be executed according to the cooling control program stored in the hard disk of the printer U. This processing will be executed in parallel processing concurrently with other various kinds of processing in the printer U.

The flowchart shown in FIG. 5 is started when the power source of the printer U is turned on.

In ST1 in FIG. 5, it is determined whether or not the image information for printing transmitted from the end terminals 1, 4 to 6 or management device 2 is received. If YES (Y), the processing proceeds to ST2, whereas if NO (N), ST1 is repeated.

In ST2, the image information received is developed into printing image information. The processing proceeds to ST3.

In ST3, it is determined whether or not the image developed is a high density image. In the first embodiment, it is determined whether or not the image density is 10% or more on the basis of the printing image information. If NO(N), the processing proceeds to ST4, whereas if YES (Y), the processing proceeds to ST8.

In ST4, it is determined whether the kind of the medium to be employed is a coated sheet. If NO (N), the processing proceeds to ST5 whereas if YES (Y), the processing proceeds to ST8.

In ST5, it is determined whether or not the environmental temperature is a high temperature. In the first embodiment, whether or not the pertinent environment is a high temperature environment is determined by determining whether or not the environmental temperature is 30° C. or higher. If YES (Y), the processing proceeds to ST6, whereas if No (N), the processing proceeds to ST8.

In ST6, it is determined whether or not the environmental humidity is a low humidity. In the first embodiment, whether or not the pertinent environment is a low humidity environment is determined by determining whether or not the environmental humidity is 30% RH or lower. If YES (Y), the processing proceeds to ST7, whereas if NO (N), the processing proceeds to ST8.

In ST7, the air volume of the blasting fans 1 to 4 of the stacker device U3*a*, U3*b* into which the sheet S is ejected is set for a small volume of air. The processing proceeds to ST9.

In ST8, the air volume of the blasting fans 1 to 4 of the stacker device U3*a*, U3*b* into which the sheet S is ejected is set for a large volume of air. The processing proceeds to ST9.

In ST9, the image forming operation is executed. The processing proceeds to ST10.

In ST10, it is determined whether or not the image forming operation has ended. If YES (Y), the processing returns to ST1, whereas if NO (N), ST10 is repeated.

(Operation of the First Embodiment)

In the image forming system SO according the first embodiment having the configuration described above, the airflow is set on the basis of the kind of the medium employed, image density, environmental temperature and environmental humidity. The air sent from the blasting fans 1 to 4 at the set airflow, as shown in FIG. 3, creates the eddy current 11 which is the flow of eddy-like air within the stacker vessel TRh1, TRh2. In FIG. 3A, the recording sheet S ejected to above the eddy current 11 created by the stacker vessel TRh1, TRh2 floats in the air owing to the eddy current 11 so that the recording sheet S is effectively cooled by the eddy current 11. When the recording sheet S is successively ejected to above the eddy current 11, the flowing recording sheet S1 is created above the eddy current 11 so that each recording sheet of a bundle S1 of the floating recording sheets is cooled by the eddy current 11.

If the number of recording sheets S constituting the bundle S1 of the floating recording sheets increases, the lowermost recording sheet S reaches the bottom of the eddy current 11 due to weight and drops onto the bottom plate TRh1*a*, TRh2*a* of the stacker vessel TRh1, TRh2 and placed thereon.

At this time, the dropping recording sheet S remains for a while in the eddy current 11 and so sufficiently cooled. In this state, the recording sheet S is placed. As a result, in the printer U according to the first embodiment, affixing between the recording sheets S is reduced as compared with the case where as for a bundle S2 of the recoding sheets placed on the bottom plate TRh1*a*, TRh2*a*, the developer constituting the image of the recording sheet S is not sufficiently cooled.

Particularly, with the medium kind, environment, image density which are prone to generate affixing, a large volume of air is set so that the recording sheet S easily floats and the floating time is prolonged to the utmost, thereby increasing the cooling efficiency. On the other hand, in the state where affixing is not prone to occur, a small volume of air is set so that the recording sheet will be swiftly placed. Namely, where cooling is needed, the cooling can be done for a long time, whereas where the cooling is not needed, the recording sheet will be swiftly placed, thereby reducing wasteful energy consumption and realizing low noise.

Further, where airflows are sent oppositely from both sides as in the conventional technique, both airflows collide with each other on the medium to disorder the air flow so that the bundle of the media S placed is likely to be disordered. On the other hand, in the first embodiment, wind disorder due to collision of the winds does not occur so that the stable eddy current 11 is created, thereby reducing the disorder of the bundle of the media S.

Further, in the case of a normal flow, a complicated configuration is required to create a uniform upward flow. On the other hand, in the first embodiment, the eddy current 11 which can be created by the fans 1 to 4 is adopted so that the upward flow can be realized in a simpler configuration than in the conventional technique.

Further, in the first embodiment in which the eddy current 11 is adopted, there is provided a configuration preferable to create the air flow at a high speed within the device with a limited space. It is needless to say that if the flow speed is high, the cooling efficiency is also high.

(Modifications)

Although the detailed explanation has been given of the exemplary embodiment of this invention, this invention should not be limited to the embodiment, but can be modified in various manners without departing from the spirit of this invention defined in claims.

(H01) In the above embodiment, as the configuration of the information communication line network N a local line, i.e. a "local area network" was exemplified. However, without being limited to it, the line network having any configuration connected with a switched line, i.e. "internet" or a dedicated line may be adopted.

(H02) In the above embodiment, as the condition for controlling the air volume, the medium kind, environment and image density were exemplified. However, without being limited to them, for example, the airflow may be controlled by determining whether or not the image information contains a photographic image.

(H03) In the above embodiment, only the airflow was controlled. However, the frames of the fans 1 to 4 may be rotatably supported so that the blowing directions can be adjusted to adjust the center position of the eddy current 11. For example, if there is a region with a high image density, by adjusting the center position of the eddy current 11 so that it is located in the region, the cooling can be done more effectively.

(H04) In the above embodiment, the respective functional unit performed the processing dispersively in the control units C, C2, C3*a*, C3*b* of the printer U but may perform the processing intensively or dispersively in a single control unit.

(H05) In the above embodiment, the configuration using the two stacker devices U3*a*, U3*b* was exemplified. However, this invention may be applied to the case where there are one or three or more stacker devices. In the above embodiment, the fans 1 to 4 were provided in both stacker devices U3*a* and U3*b*, they may be provided in only either one of them. Further, the configuration of the stacker device should not be limited to that exemplified in the embodiment, but it may be applied to the ejecting portion located on the image forming apparatus or the stacker tray of a post-processing device. Namely, without being limited to the case where the stacker has a bottom plate arranged horizontally, this invention can be applied to the stacker tray inclined to the horizon.

(H06) In the above embodiment, as an example of the eddy current generating device, the fans 1 to 4 were exemplified. However, without being limited to this configuration, for example, a blower and others may be employed. Further, the number of the fans should not be limited to four, but may by any number capable of generating the eddy current, i.e. three or less, or five or more.

The foregoing description of the embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention defined by the following claims and their equivalents.

What is claimed is:

1. A image forming apparatus comprising: a heating device; and a cooling device comprising:

a stacker vessel in which a medium having a fixed visible image is ejected and stacked; and an eddy flow generating device that is arranged in an upper portion of the stacker vessel, and generates an eddy flow which flows along a surface of the medium transported into the stacker vessel to make an eddy and cools the medium;

an eddy current generating unit that floats the medium in the upper portion of the stacker vessel, and cools the medium, an image density determining unit determines whether or not the image density of the fixed visible image on the surface of the medium is higher than a predetermined image density, and an eddy current controlling unit controls, in a case where the image density on the surface of the medium is higher than the predetermined image density, the eddy current generating unit to increase volume of an air supplied from the eddy current generating unit, wherein the heating device includes a fixing device that fixes a non-fixed visible image carried on the surface of the medium.

2. The image forming apparatus as claimed in claim 1, wherein the heating device includes a fixing device that fixes a non-fixed visible image carried on the surface of the medium.

3. The image forming apparatus as claimed in claim 1, further comprising a medium type determining unit that determines a type of the medium, wherein the eddy current controlling unit controls, in a case where the type of the medium is a predetermined fixing-prone medium, the eddy current generating unit to increase volume of an air supplied from the eddy current generating unit.

* * * * *